US008256347B2

(12) United States Patent
Gutfleisch et al.

(10) Patent No.: US 8,256,347 B2
(45) Date of Patent: Sep. 4, 2012

(54) METHOD AND APPARATUS FOR TREATING A REIMAGABLE PRINTING PLATE

(75) Inventors: Martin Gutfleisch, Dossenheim (DE); Matthias Schlörholz, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1263 days.

(21) Appl. No.: 11/372,437

(22) Filed: Mar. 9, 2006

(65) Prior Publication Data

US 2006/0201358 A1 Sep. 14, 2006

Related U.S. Application Data

(60) Provisional application No. 60/659,939, filed on Mar. 9, 2005.

(30) Foreign Application Priority Data

Mar. 9, 2005 (DE) ..... 10 2005 011 192

(51) Int. Cl.
*B41C 1/10* (2006.01)
*B41F 7/02* (2006.01)
*B41M 1/06* (2006.01)

(52) U.S. Cl. ..... 101/451; 101/453; 101/467; 101/478

(58) Field of Classification Search ..... 101/478
See application file for complete search history.

(56) References Cited

U.S. PATENT DOCUMENTS

| | | | | |
|---|---|---|---|---|
| 3,647,499 | A * | 3/1972 | Colt et al. | 430/49 |
| 5,030,742 | A * | 7/1991 | Tieke | 556/136 |
| 6,082,263 | A | 7/2000 | Koguchi et al. | |
| 6,318,264 | B1 | 11/2001 | D'Heureuse et al. | |
| 6,321,652 | B1 | 11/2001 | Fujinami et al. | |
| 6,851,366 | B2 | 2/2005 | Gutfleisch et al. | |
| 2002/0017209 | A1 * | 2/2002 | Gutfleisch et al. | 101/424 |
| 2004/0007146 | A1 * | 1/2004 | Gutfleisch et al. | 101/401.1 |
| 2007/0062389 | A1 | 3/2007 | Link | |

FOREIGN PATENT DOCUMENTS

| | | | |
|---|---|---|---|
| DE | 10037998 | A1 | 2/2002 |
| DE | 102 27 054 | A1 | 12/2003 |
| EP | 0374099 | A1 | 6/1990 |
| EP | 0 911 154 | A1 | 4/1999 |
| EP | 0 962 333 | A1 | 12/1999 |
| EP | 0963839 | A1 | 12/1999 |
| EP | 1177914 | A2 | 2/2002 |
| EP | 1375136 | A1 | 1/2004 |
| WO | 03070461 | A1 | 8/2003 |

OTHER PUBLICATIONS

Hofer R. et al., "Alkyl Phosphate Monolayers, Self-Assembled from Aqueous Solution onto Metal Oxide Surfaces", Langmuir, 2001, 17, 4014-4020.

European Search Report dated Dec. 7, 2010.

* cited by examiner

*Primary Examiner* — Joshua D Zimmerman
(74) *Attorney, Agent, or Firm* — Laurence A. Greenberg; Werner H. Stemer; Ralph E. Locher

(57) ABSTRACT

A reusable printing form is treated after printing. The printing form has a substrate provided with amphiphilic molecules and it is cleaned to remove printing ink and provided with amphiphilic molecules, for fresh printing in the course of a reimaging process. Here, the printing form is provided with amphiphilic molecules in the course of the reimaging process substantially before cleaning to remove the printing ink.

12 Claims, 2 Drawing Sheets

METHOD AND APPARATUS FOR TREATING A REIMAGABLE PRINTING PLATE

CROSS-REFERENCE TO RELATED APPLICATIONS

This application is is based, under 35 U.S.C. §119(e), on provisional application No. 60/659,939, filed Mar. 9, 2005; this application also claims the priority, under 35 U.S.C. §119(a), of German patent application No. 10 2005 011 192.0, filed Mar. 9, 2005; the entire disclosure of the prior applications is herewith incorporated by reference.

BACKGROUND OF THE INVENTION

Field of the Invention

The invention lies in the printing technology field. More specifically, the invention relates to a method of treating a reimagable printing plate after printing. The printing plate has a substrate provided with amphiphilic molecules and is cleaned to remove printing ink and provided with amphiphilic molecules for fresh printing in the course of a reimaging process. Furthermore, the present invention relates to an apparatus for the treatment of a reimagable printing plate after printing. The apparatus has a cleaning unit for cleaning the printing plate to remove printing ink and a unit for covering the printing plate with amphiphilic molecules.

Printing plates are described in the prior art, in particular those for offset printing, that can be designed in such a way that they they are useable not only for one printing process but for a plurality of printing processes producing different printed images. Those plates may be designated as reusable or reimagable printing plates. Before a printing plate which was inked for printing with printing ink can be provided with a new printing image for a further printing process, the residual ink remaining on the surface of the printing plate from the preceding printing process must be removed from the surface in a cleaning step. If need be, the cleaned printing plate surface must be activated before a reimaging process, for example by exposure to UV light.

Commonly assigned German published patent application DE 102 27 054 A1 and its counterpart U.S. Pat. No. 6,851,366 B2 describe a reusable printing plate, in particular for use in offset printing. There, the printing plate has, for example, a substrate of titanium with a naturally oxidized titanium surface that is covered with amphiphilic molecules in aqueous or alcoholic solution, for example with a hydroxamic acid or a phosphonic acid, in such a way that the printing plate has a hydrophobic surface. The printing plate can be imaged by means of infrared light, the amphiphilic molecules being removed in the areas which were exposed to infrared light and the hydrophilic surface of the printing plate being bared.

After a printing process, the surface of the printing plate is cleaned or freed from printing ink, for example with the aid of a commercial cleaning agent, such as Eurostar (from DC Druck Chemie GmbH, Ammerbuch-Altingen in Germany), and erased extensively using UV light. Thereafter, the surface of the printing plate is covered with amphiphilic molecules.

U.S. Pat. No. 6,082,263 and its counterpart European published patent application EP 0 911 154 A1 (both based on JP 9-292617 and JP 9-292619) likewise disclose the use of a titanium dioxide surface as a reimagable printing plate. There, too, UV erasing is provided and the printing plate is cleaned to remove printing ink directly after the end of printing in a wash station.

It would be desirable, and advantageous in terms of cost aspects, to be able to dispense with an erasing apparatus, such as, for example, the UV erasing apparatuses used in the publications cited above, or other known erasing apparatuses, such as, for example, plasma erasing apparatuses or mechano-chemical apparatuses, and instead provide only a cleaning apparatus and an apparatus for coverage with amphiphilic molecules. Since the production is interrupted during the reimaging, it is also desirable to reduce to a minimum or even to avoid this interruption by complicated erasing processes with long process times.

U.S. Pat. No. 6,321,652 B1 and its counterpart European published patent application EP 0 962 333 A1 (both based on JP 9-024013 and JP 9-155164) describe a reimaging process wherein, after the end of printing, all self-organizing molecules present on the surface of the printing plate used are first removed by supplying energy and a fresh layer of these molecules is applied.

Since the process step of removing self-organizing molecules also takes time and thus results in production downtimes, it would furthermore be desirable to be able to dispense with this removal.

From a publication by R. Hofer et al. in Langmuir 2001, 17, 4014-4020, special amphiphilic molecules in aqueous solution are already known.

SUMMARY OF THE INVENTION

It is accordingly an object of the invention to provide a method and apparatus for treating reusable printing forms which overcome the above-mentioned disadvantages of the heretofore-known devices and methods of this general type and which in each case enable a reimagable printing plate to be brought in a simple manner into a homogeneously hydrophobic starting state defined for fresh imaging and fresh printing.

With the foregoing and other objects in view there is provided, in accordance with the invention, a method of treating a reusable printing form following printing, which comprises:

providing a printing form having a substrate and amphiphilic molecules on the substrate;

subjecting the printing form to a reimaging process including the steps of providing the printing form with amphiphilic molecules for fresh printing; and subsequently cleaning the printing form to remove printing ink.

In other words, the method according to the invention for the treatment of a reusable printing form (e.g. a printing plate) after printing, the printing plate having a substrate provided with amphiphilic molecules and being cleaned to remove printing ink and provided with amphiphilic molecules for fresh printing in the course of a reimaging process, is distinguished in that the printing plate is provided with amphiphilic molecules substantially before the cleaning to remove printing ink in the course of the reimaging process.

According to the invention, and contrary to the solutions of the prior art, in the process the reimagable printing plate is provided with amphiphilic molecules in the still uncleaned state, i.e. in the state provided with printing ink. The amphiphilic molecules applied to the surface of the printing ink reach the surface of the printing plate at least in those areas of the printing plate which are not provided with printing ink and bind there. In this way, the surface of the printing plate can be covered with amphiphilic molecules over the whole area before the printing plate is cleaned to remove printing ink. It has proven particularly advantageous that the procedure for cleaning after the recovering with amphiphilic molecules can be carried out in a relatively simple manner and in particular lends to a satisfactory cleaning result in a short time, since the printing ink does not come directly into contact with the surface of the substrate. After cleaning, that surface of the printing plate which is already covered with amphiphilic molecules beforehand is therefore available for a fresh imaging process and subsequent fresh printing. A separate step of erasing of the printing plate can advantageously be avoided in this way since the printing plate is converted into a defined, homogeneously hydrophobic state and hence into an erased state by the application of the amphiphilic molecules.

According to a preferred embodiment of the invention, the printing form is provided with molecules present in aqueous solution. By using amphiphilic molecules in aqueous solution, problems which arose in relation to the use of alcoholic solutions owing to low flashpoints can advantageously be avoided. At the same time, there is the advantage that the water-soluble amphiphilic molecules can very readily diffuse to the surface of the substrate owing to the fountain solution on the printing plate surface and can bind there. In addition there is the advantage that the aqueous solution does not partially dissolve the substrate which would be expected with the use of ethanolic solution.

According to an embodiment of the invention which is particularly preferred in this respect, the printing plate is provided with alkylphosphonic acid present in aqueous solution and/or with an alkylphosphonic acid salt present in aqueous solution. Alternatively, the printing plate can also be provided with alkyl phosphate present in aqueous solution and/or with an alkyl phosphate salt present in aqueous solution.

According to a further, particularly preferred embodiment of the invention, the printing plate is washed with water, in particular with distilled water, in the course of the reimaging process before and/or after the provision with amphiphilic molecules. By rinsing the printing plate before provision with amphiphilic molecules, the fountain solution present on the printing plate is replaced by water, by means of which the amphiphilic molecules can more easily reach the surface of the printing plate than by means of the fountain solution to which auxiliaries have been added. By rinsing the printing plate after provision with amphiphilic molecules, an excess of such molecules can be removed in a simple manner.

A further embodiment of the method according to the invention is distinguished in that the printing plate is imaged with infrared radiation in the course of the reimaging process. In the imaged areas, the amphiphilic molecules are removed from the surface of the printing plate and the hydrophilic property of the printing plate leads to good moistening in these areas, i.e. to very good wetting with fountain solution. According to a further, particularly preferred embodiment of the invention, the hydrophilic property of the printing plate can be improved by treating the printing plate with a gumming agent in the course of the reimaging process. This accumulates in the imaged areas of the printing plate surface and influences the hydrophilic property in a positive manner.

The method according to the invention for the treatment of a reimagable printing plate after printing and the advantageous embodiments of the process can furthermore be used in a wet offset printing process wherein a reimagable printing plate which has a substrate provided with amphiphilic molecules is used.

With the above and other objects in view there is also provided, in accordance with the invetion, an apparatus for treating a reimagable printing form after printing, the printing form having a substrate provided with amphiphilic molecules. The apparatus comprises:

a cleaning unit for cleaning the printing form to remove printing ink;

a covering unit for covering the printing form with amphiphilic molecules; and a control unit connected to the covering unit and configured to actuate the covering unit for covering the printing form with amphiphilic molecules substantially before the cleaning unit in the course of a reimaging process of the printing form.

In other words, the apparatus according to the invention for the treatment of a reimagable printing plate after printing—the printing plate having a substrate provided with amphiphilic molecules—includes a cleaning unit for cleaning the printing plate to remove printing ink and a unit for covering the printing plate with amphiphilic molecules. The novel system is distinguished in that the apparatus has a control unit which actuates the unit for covering the printing plate with amphiphilic molecules in such a way that the unit becomes operational, in the course of a reimaging process, substantially before the cleaning unit.

The actuation according to the invention is associated with the same advantages as described above with reference to the method according to the invention.

An apparatus according to the invention can be used in a machine processing a print medium, in particular in an offset printing press.

Other features which are considered as characteristic for the invention are set forth in the appended claims.

Although the invention is illustrated and described herein as embodied in a process and apparatus for the treatment of a reimagable printing plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
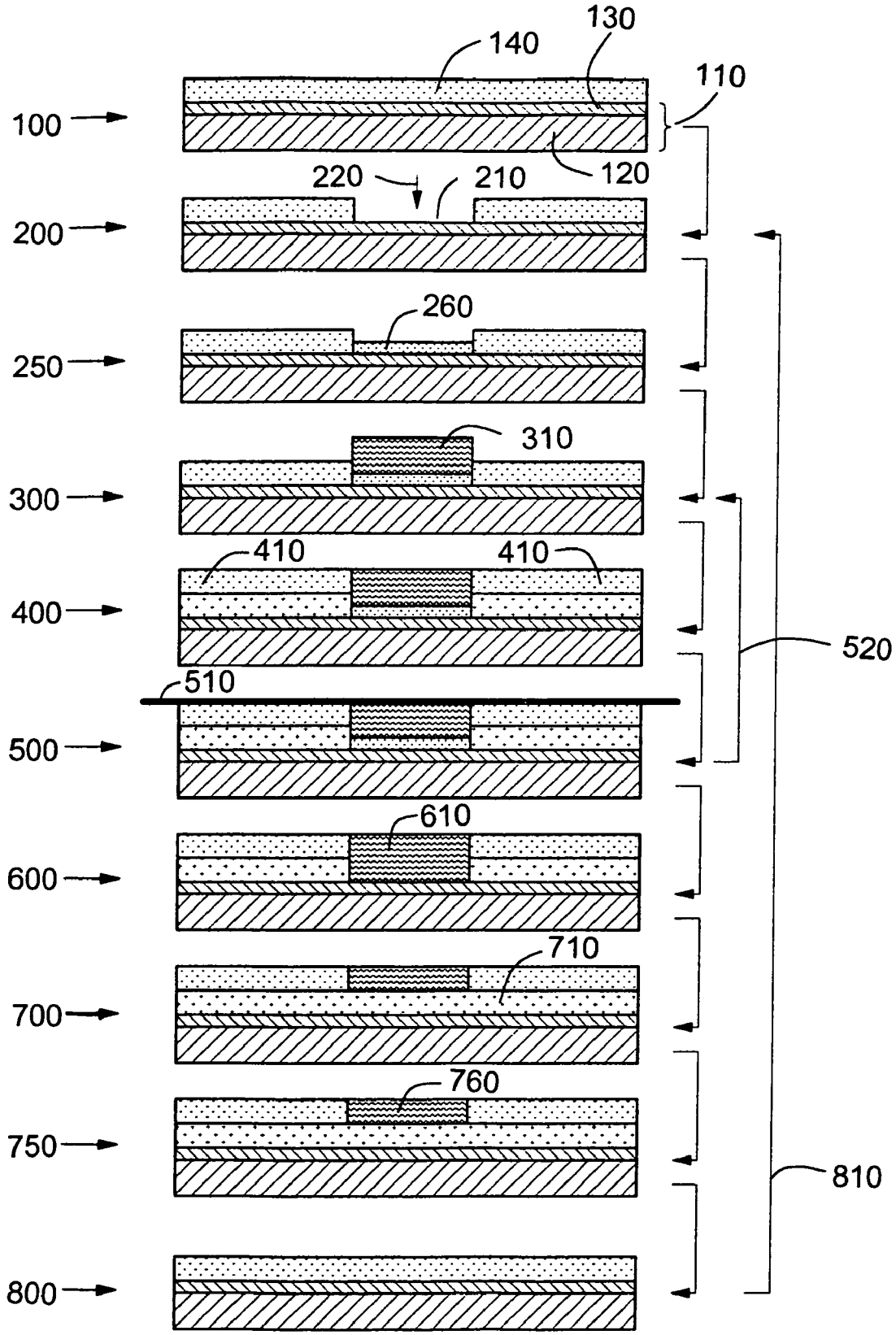
FIG. 1 illustrates a sequence of an embodiment of the method according to the invention.

Referring now to the figures of the drawing in detail and first, particularly, to FIG. 1 thereof, the schematically illustrated sequence represents an embodiment of the method according to the invention. In a process step 100 (provision), a titanium printing plate 110 which has a substrate 120 of titanium (Ti) and an oxidized surface 130 of titanium dioxide ($TiO_2$)—alternatively of $TiO_x$, $ZrO_2$, $Al_2O_3$, another metal oxide or stainless steel—and a covering on the surface 130. The covering comprises a layer 140 of amphiphilic molecules. As a result of the covering with the amphiphilic molecules, the surface of the printing plate 110 has a defined homogeneous water repellancy.

In a first preparation of the printing plate 110 before printing for the first time, the printing plate can be precleaned in a first step with acetone and cleaned and activated with ultraviolet radiation (example: use of a Xenon excimer UV emitter having an intensity of 45 mW/cm$^2$ and a wavelength of 172 nm; application about 10 minutes). In a second step of the first preparation, the printing plate 110 can be immersed in 1 mM aqueous solution of amphiphilic molecules for up to 60 seconds, with the result that the surface of the printing plates 110 acquires a hydrophobic character and becomes oleophilic for conventional offset printing inks. Furthermore titanium printing plates can also be roughened during the first preparation, a roughness (RMS) of about 350 nm having proven useful.

In a process step 200 (imaging), the printing plate 110 is exposed in non-image areas 210 i.e. in those areas which should not accept any ink, to infrared radiation 220 (example: wavelength about 810 to 1100 nm, power about 1 to 5 W, energy density (fluence) about 30 to 40 J/cm$^2$ at an imaging speed, i.e. a movement of the printing plate, of about 1 to 2 m/s) in the form of a negative image, with the result that the layer 140, i.e. the amphiphilic molecules, is removed in the areas 210.

As a result of the irradiation, hydrophilic regions are produced image point by image point. In this way, image information (positive image) in the form of remaining amphiphilic molecules is superposed on the printing plate 110 or image information is written into the printing plate 110.

In an optional process step 250 (hydrophilization), the imaged printing plate surface is wetted with a gumming agent 260, for example the product AGUM-Z based on gum arabic (available from Hanns Eggen GmbH & Co. KG, Sarstedt, Germany) and hydrophilized in the imaged areas.

In a process step 300 (dampening), the printing plate 110 is provided with fountain solution 310, which adheres to the previously imaged and optionally gummed areas 210.

In a process step 400 (inking), the printing plate 110 is provided with printing ink 410, which adheres to the areas of the printing plate that are covered with amphiphilic molecules 140. The areas of the printing plate 110 which are covered with fountain solution 310 and are therefore lipophobic, on the other hand, do not accept any printing ink.

After the dampening 300 and the inking 400, the surface of the printing plate 110 has a printing image in the form of printing ink and fountain solution regions and can therefore be used for printing in a process step 500 (printing), for example in a conventional wet offset printing process and in appropriately equipped offset printing presses, for which purpose the surface of the printing plate 110 is brought into contact with a print medium 510. The printing image can be printed several times. It is possible for the printing plate 110 to be moistened and inked again by a repetition 520 of the steps 300 and 400.

In an optional process step 600 (washing), the printing plate 110 is washed with distilled water 610, which displaces the fountain solution present on the surface 110 and which may also comprise dirt.

In a process step 700 (covering), the printing plate 110 which has not yet been cleaned to remove printing ink (or ink/fountain solution emulsion) is treated, for example sprayed (alternatively: e.g. immersion or rolling on), with an aqueous solution of amphiphilic molecules which reach the surface of the printing plate 110 in the areas 210 wherein fountain solution and/or distilled water is present and accumulate there, so that the surface 110 is covered over the whole area with amphiphilic molecules 710 and the prior printing image is erased. In other words, the previously imaged areas are—prior to cleaning to remove printing ink—replenished with amphiphilic molecules. If the printing plate 110 was washed beforehand in process step 600 with distilled water, the amphiphilic molecules now need diffuse only through the distilled water and not through the fountain solution, which may contain not only water but also isopropyl alcohol (IPA) and additives, to the printing plate surface, which advantageously leads to a better result in the covering with amphiphilic molecules and hence to better erasing of the image information. The time of action of the aqueous solution of amphiphilic molecules is preferably about one minute. Sufficient water repellancy of the surface is, however, achievable after only a few seconds.

The following substances are preferably chosen as amphiphilic, water-soluble molecules:

alkylphosphonic acids or salts of alkylphosphonic acids (phosphonates):

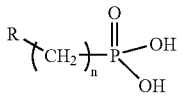

alkylphosphonic acids
where n=1-15

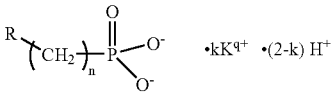

salts of alkylphosphonic acids (phosphonates)
where n=1-15; q, k=0-2 alkyl phosphates or salts of alkyl phosphates (phosphatates)

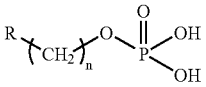

alkyl phosphates
where n=1-15

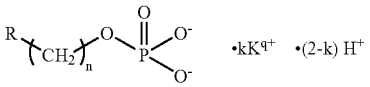

salts of alkyl phosphates (phosphatates)
where n=1-15; q, k=0-2
K=cation (e.g. Ca, K, Na, Cs, Mg)
R=

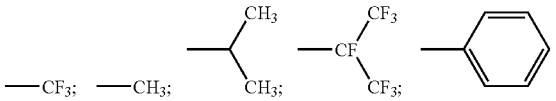

Preferably a 0.1 to 1 mM aqueous solution is used.

In an optional process step 750 (rinsing), the printing plate 110 can be washed once more with distilled water 760. As a result, an excess of amphiphilic molecules can be removed.

In a process step 800 (cleaning), the printing plate 110 is cleaned to remove printing ink 410. The cleaning can be effected with the use of one or more cleaning agents, for example of the commercial cleaning agent Eurostar and IPA.

Furthermore, the printing plate 110 can be washed with ethanol and then blown dry, for example, with nitrogen.

After cleaning is complete, the printing plate 110 is in a state which corresponds to the state of the printing plate in the provision step 100, i.e. the printing plate 110 can be imaged, moistened, inked, printed and then processed (covered and cleaned) again by a repetition 810. In this way, the printing plate can be used several times.

The process steps of washing 600, of covering 700, of rinsing 750, of cleaning 800, of imaging 200 and of hydrophilizing 250 can also be understood together as a reimaging process, it not being necessary for the imaging process to comprise all these steps. Thus, for example, the optional process step can be omitted.

Figure 2:
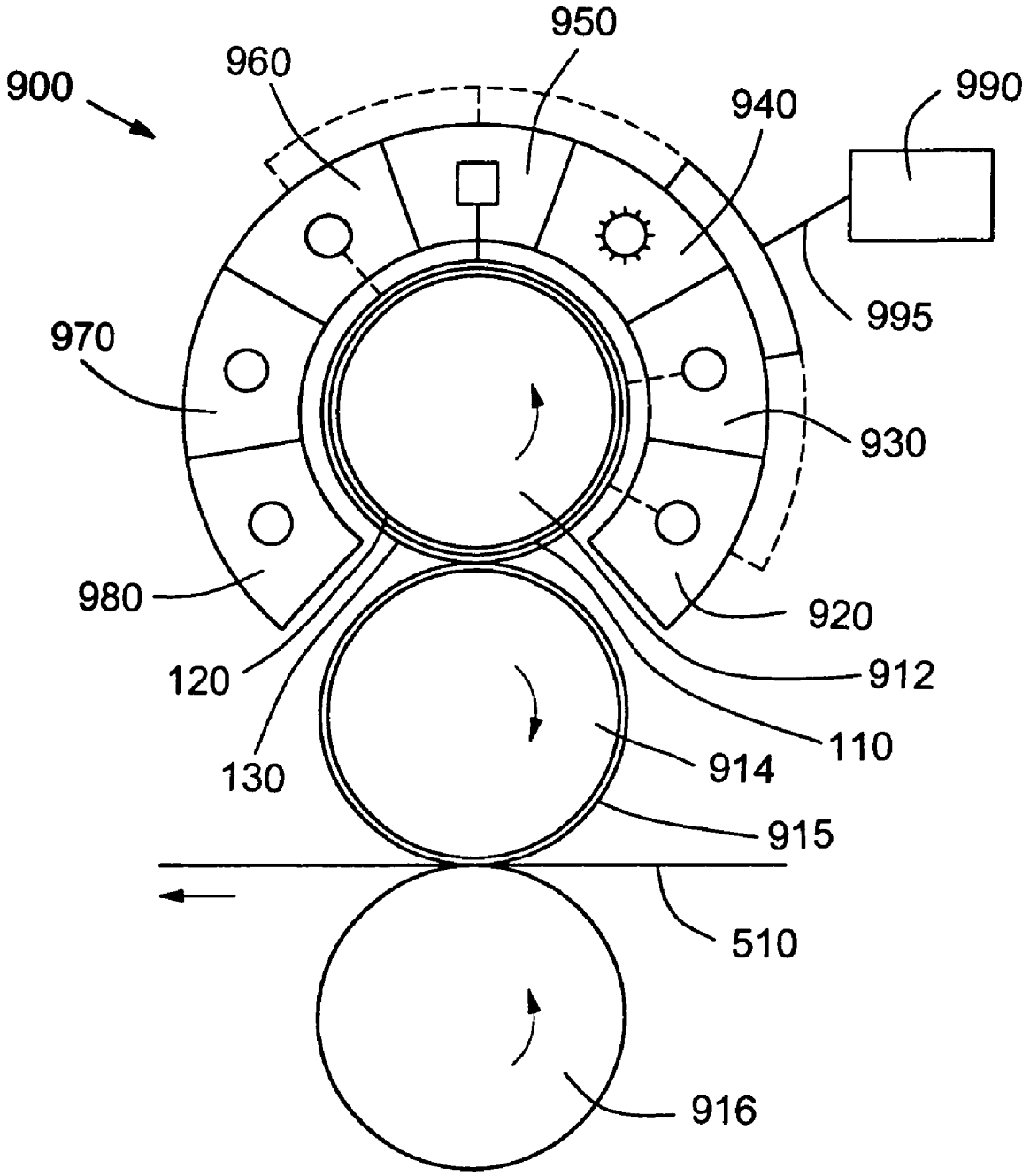
FIG. 2 is a diagrammatic side elevational view of an exemplary embodiment of an apparatus according to the invention.

FIG. 2 schematically shows the construction of an embodiment of the apparatus according to the invention. The apparatus has a printing plate cylinder 912, a transfer cylinder 914 and an impression cylinder 916. A printing plate 110 having a substrate 120 and a surface 130 is disposed on the printing plate cylinder 912, and a rubber blanket 915 is provided on the transfer cylinder 914. A print medium 510 is shown in the nip between the transfer cylinder 914 and the impression cylinder 916 as it is being printed with printing ink.

After printing, the printing plate cylinder 912 can optionally be removed from the transfer cylinder 914. A washing unit 920 sprays the surface of the printing plate 110 with distilled water, with the result that the fountain solution is displaced or washed away.

A covering unit 930 for covering the printing plate 110 with amphiphilic molecules in aqueous solution is disposed downstream of the unit 920 in the direction of rotation of the printing plate cylinder 912 at the periphery thereof and sprays the surface of the printing plate 110 with the aqueous solution of amphiphilic molecules with the result that a layer of amphiphilic molecules forms over the whole area and the prior printing image is erased.

In the direction of rotation, there follows a cleaning unit 940 which removes the printing ink from the surface of the printing plate 110, for example by means of a brush washer (alternatively, the printing ink can also be removed by means of a blanket washer or by means of a washer coordinated with an inking unit).

There furthermore follows an imaging unit 950 which has an infrared laser that writes a negative image (or a positive image, depending on the technology employed) onto the printing plate 110 by means of infrared laser radiation and thus images the plate, and there optionally follows a development unit 960 which wets the surface of the printing plate 110, for example with a gumming agent for water repellancy.

Furthermore downstream are a dampening unit 970 and an inking unit 980, which provide the printing plate 110 with fountain solution and printing ink. The printing plate 110 is thus available for fresh printing after washing, covering, rinsing, cleaning, imaging and hydrophilization.

The apparatus 900 has a control unit 990 which actuates at least the units 930 and 940 via connections 995 during a reimaging process, the actuation being designed in such a way that the unit 930 is operational before the unit 940, i.e. covering of the printing plate 110 with amphiphilic molecules in aqueous solution is effected substantially before cleaning of the printing plate 110 to remove printing ink.

The printing form 110 of the exemplary embodiment is a printing plate 110. It will be understood that the printing form 110 may also be a fixed peripheral surface of the printing cylinder 912.

We claim:

1. A method of treating a reimagable printing form following printing, which comprises:

providing a printing form having a substrate and amphiphilic molecules on the substrate;

subjecting the printing form to a reimaging process including the steps:

providing the printing form, which has not yet been cleaned to remove printing ink, with amphiphilic molecules for fresh printing; and subsequently cleaning the printing form to remove printing ink.

2. The method according to claim 1, which comprises providing the amphiphilic molecules to the printing form in aqueous solution.

3. The method according to claim 1, which comprises providing the printing form with alkylphosphonic acid in aqueous solution and/or with an alkylphosphonic acid salt in aqueous solution.

4. The method according to claim 1, which comprises providing the printing form with alkyl phosphate in aqueous solution and/or with an alkyl phosphate salt in aqueous solution.

5. The method according to claim 1, which comprises washing the printing form with water in the course of the reimaging process before and/or after providing the amphiphilic molecules.

6. The method according to claim 5, which comprises washing the printing form with distilled water.

7. The method according to claim 1, which comprises imaging the printing form with infrared radiation in the course of the reimaging process.

8. The method according to claim 1, which comprises treating the printing plate with a gumming agent in the course of the reimaging process.

9. A wet offset printing process, comprising printing with a reusable printing form having amphiphilic molecules on a printing surface thereof, and reimaging the reusable printing form with the method according to claim 1.

10. An apparatus for treating a reimagable printing form after printing, the printing form having a substrate provided with amphiphilic molecules, and the apparatus comprising:

a cleaning unit for cleaning the printing form to remove printing ink;

a covering unit for covering the printing form with amphiphilic molecules; and a control unit connected to said covering unit and configured to actuate said covering unit for depositing the amphiphilic molecules on the printing form, which has not yet been cleaned to remove printing ink, substantially before actuating said cleaning unit in the course of a reimaging process of the printing form.

11. In a print medium-processing machine, at least one apparatus according to claim 10.

12. In an offset printing press, at least one apparatus according to claim 10.

* * * * *